US006960000B2

(12) United States Patent
Harrison

(10) Patent No.: US 6,960,000 B2
(45) Date of Patent: Nov. 1, 2005

(54) DARTBOARD ILLUMINATION METHOD AND APPARATUS

(75) Inventor: Scott Harrison, Austin, TX (US)

(73) Assignee: Nuvolux, Inc., Austin, TX (US)

( * ) Notice: Subject to any disclaimer, the term of this patent is extended or adjusted under 35 U.S.C. 154(b) by 0 days.

(21) Appl. No.: 10/614,256

(22) Filed: Jul. 3, 2003

(65) Prior Publication Data

US 2005/0002193 A1 Jan. 6, 2005

(51) Int. Cl.[7] ..... F21V 7/10
(52) U.S. Cl. ..... 362/216; 362/217; 362/311; 362/367; 362/583; 362/19
(58) Field of Search ..... 273/348.2–348.5, 273/404; 473/447, 570, 578, 574; 362/216, 362/217, 240, 244, 248, 311, 326, 367, 583, 362/19

(56) References Cited

U.S. PATENT DOCUMENTS 2,323,059 A * 6/1943 Land ..... 359/498
2,413,662 A * 12/1946 Thomas ..... 313/318.02
3,802,708 A * 4/1974 Libert ..... 273/237

FOREIGN PATENT DOCUMENTS

GB 1541737 A1 * 3/1979 ..... A47B 81/00

* cited by examiner

*Primary Examiner*—Sandra O'Shea
*Assistant Examiner*—Sharon Payne
(74) *Attorney, Agent, or Firm*—Patrick Stellitano

(57) ABSTRACT

The present invention provides apparatus and methods for illuminating a dartboard comprising filtering of an illumination source from direct view by the player while protecting the illumination source from damage or breakage by darts or other objects.

19 Claims, 4 Drawing Sheets

DARTBOARD ILLUMINATION METHOD AND APPARATUS

TECHNICAL FIELD OF THE INVENTION

The present invention relates to the field of dartboard illumination.

BACKGROUND OF THE INVENTION

Throwing darts is a familiar sport that is enjoyed by millions of people around the world. The game is entertaining and competitive. It is played in homes, recreation centers, restaurants, bars, and other venues. These different venues present a large variety of illumination settings for the game. Thus, the dartboard may be dimly lit, or may present glare to the player, or be cast with uneven shadows, including shadows cast on the board by the darts themselves. Conventionally, special lighting is sometimes provided to illuminate the board, but the provision of special lighting can be expensive, difficult to control, and rarely provides satisfactory illumination. Thus, there is a need for a method and apparatus for dartboard illumination that overcomes these and other limitations of the prior art.

SUMMARY OF THE INVENTION

Accordingly, the present invention presents methods and apparatus for dartboard illumination that overcome limitations of the prior art. According to the present invention, easily controllable illumination of the board is provided that is substantially uniform across the dartboard face, and substantially shadow-free and glare-free. Illumination, provided by a distributed light source, or a plurality of light sources, emanates from about the periphery of the dartboard. The light source may be shaped to conform to the circular shape of the board or may be rectangular to be positioned more easily in a cabinet containing the board. The illumination may be emitted by a single distributed light source such as a tubular fluorescent bulb or tubular neon lamp that surrounds the entire periphery or a substantial portion of the periphery of the dartboard to provide omni- or substantially omni-directional illumination. Or the illumination may be emitted by a plurality of discrete sources distributed around the periphery of the board to provide sufficient multi-directional illumination to substantially minimize shadows and glare and provide substantially uniform illumination.

The illumination will emit light from and about the periphery of the board inward toward and across the surface of the board, providing substantially uniform, shadow-free, glare-free illumination thereof. Thus, for example, shadows cast from darts sticking in the board are substantially minimized because of the omni- or multi-directional nature of the illumination.

According to an aspect of the invention, the illumination may be provided using a neon or fluorescent bulb, incandescent bulbs, or other suitable light source, presently existing or to be developed, that is adaptable to achieve one or more objects of the present invention. Thus, the illumination may be white light or light of a desired color, and can further be set to a desired intensity.

According to another aspect of the invention, the illumination is filtered to control the amount of illumination that travels directly from a source to a player. This enables control of the intensity and color of that direct illumination. In fact, the filter can be opaque, so that the indirect illumination that is diffusely reflected off the dartboard is substantially the only illumination from the source visible by the player. Moreover, a reflecting surface may be provided to enhance the amount of illumination that is reflected toward the board. Further, a translucent protective surface is provided to protect the light source from damage by a stray or rebounding dart or other object that could cause breakage, while enabling all or a desired portion of the visible spectrum to transmit through the protective surface to illuminate the board.

The foregoing has outlined rather broadly aspects, features and technical advantages of the present invention in order that the detailed description of the invention that follows may be better understood. Additional aspects, features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
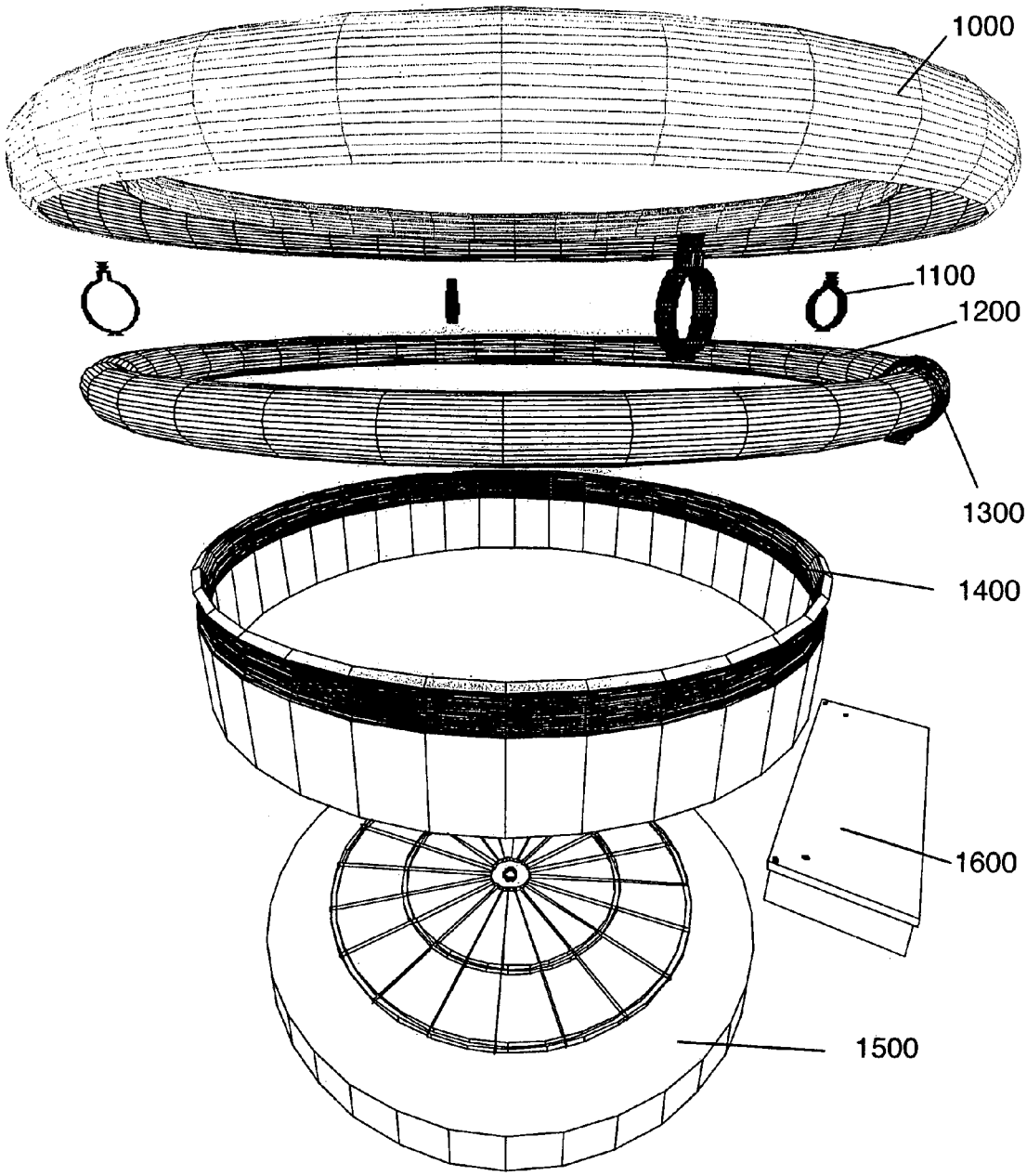
FIG. 1 shows assembly of a preferred embodiment of the invention.

Assembly of a preferred embodiment of the present invention is shown in FIG. 1. Tubing 1000 is formed to receive a fluorescent lamp 1200. Fluorescent lamp 1200 is secured to tubing 1000 using clips 1100. Fluorescent lamp 1200 is connected to an electrical source at its ends by a T9 Circline™ connector 1300, or other suitable connector. Interior to the circle formed by fluorescent lamp 1200 is a translucent protector 1400, which is either translucent or transparent to enable light to pass there through. Protector 1400 is dimensioned to fit snugly around the periphery of a dartboard 1500. A ballast 1600 is provided for fluorescent lamp 1200.

Figure 2:
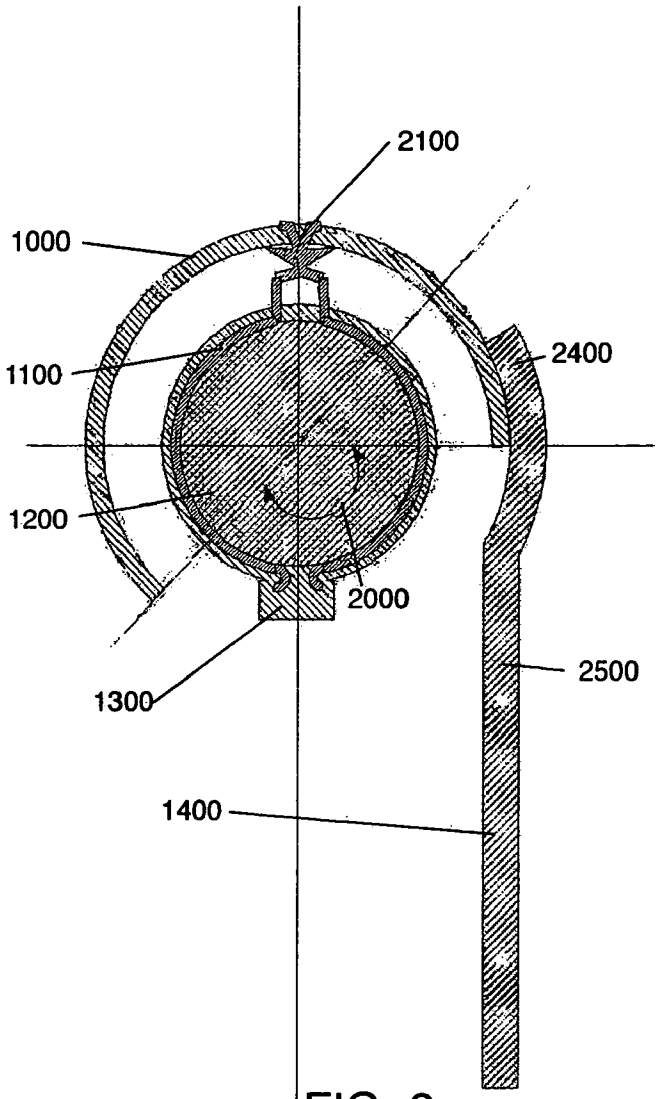
FIG. 2 is a cross-sectional view of a portion of the assembly of FIG. 1.

A cross-sectional view of a portion of the assembly of FIG. 1 is shown in FIG. 2. Tubing 1000 may be formed by rolling 2 inch diameter aluminum tubing into a circular form having a diameter of 20 inches, measured from the centerline of the tubing. The ends may be welded together. An angular sector 2000 is cut from tubing 1000 to enable insertion of fluorescent lamp 1200, and to allow light to illuminate the dartboard, while shielding direct light transmission from lamp 1200 to a player in front of the dartboard in a position to throw darts. For example, a preferred angular sector 2000 may be chosen to be 135 degrees, as shown in FIG. 2. Making an interior surface of tubing 1000 reflective will cause illumination impinging on said reflecting surface to be reflected back toward the dartboard. Alternatively, tubing 1000 may be formed from a partially opaque material to form a surface to control and filter the amount of light emanating directly toward the player. The partial opacity can operate over the entire visible spectrum or any portion thereof. Generally, there will be desired no direct light emanating directly from the source of illumination toward the player, to prevent interference by said direct light. However, partial visibility of some region of the visible spectrum of the source may be desirable for aesthetics or functional contrast. Thus, for example, a white light source could illuminate the board, whereas the partial opacity of tubing 1000, will cause direct light of a desired intensity and desired color, say green, to be visible to the player.

Clips 1100 are received through holes at 2100 in tubing 1000. Preferably four clips 1100 are distributed evenly about the circumference of tubing 1000 to hold fluorescent lamp 1200 in place within tubing 1000, but away from the interior wall of tubing 1000. Fluorescent lamp 1200 is preferably formed of tubing that is 1⅛ inch in diameter (T9 size), and formed in a circle of 20-inch diameter, measured from the centerline of the tubing. This enables use of T9 Circline lamp connector 1300, with radius identical to the lamp tubing.

Translucent protector 1400 is molded from vinyl or other suitable material that is transparent or translucent to allow light to pass there through and illuminate the dartboard, while protecting the light from being struck by darts or other objects. Thus, translucent protector 1400 provides a translucent protective surface to prevent physical impact to a source of the illumination, thereby preventing damage to the source. At an end 2400 of protector 1400 is formed a curved surface to conform to the curvature of the exterior wall of tubing 1000. This enables protector 1400 to be secured to tubing 1000 at various, preferably, equally spaced points. Protector 1400 may be secured to tubing 1000 using rivets or other suitable means. For example, commercially available ⅛ inch pop rivets spaced an inch apart may be employed.

A straight segment 2500 of translucent protector 1400 enables the dartboard 1500 to fit snugly within the interior of the circumference of protector 1400, thereby removably mounting the inventive apparatus securely to the dartboard by frictional forces. In the alternative, the dartboard may be secured within the interior of the circumference of protector 1400 with screws, adhesive or other means.

Translucent protector 1400 may be formed from commercially available transparent or translucent vinyl, by cutting a 3 inch wide piece of ⅛ inch to ¼ inch thick vinyl of sufficient length to form a circle of about 18 inches in diameter. Protector 1400 may be translucent across the entire spectrum of visible light, or translucent across only a portion of the spectrum, thereby creating a color filter, to illuminate the dartboard with a desired intensity and color or color segment of the visible spectrum. Moreover, translucent polarized material may be employed as protector 1400 or as a full or partial coating of protector 1400, to filter out a polarization of the illumination passing there through.

Note that tubing 1000 and protector 1400 both serve to protect the source of illumination from damage. Clearly, in an alternative embodiment, tubing 1000 and protector 1400 may be formed from one unitary piece of vinyl or other suitable translucent material to produce a unitary translucent protective element. Then, a reflective, opague, or partially opaque or polarizing material may be applied to that portion of the element that enables control of the intensity, color, and polarization of illumination emanating directly from the source to the player, while affecting the amount of illumination reflected from the protective element toward the dartboard. Moreover, a tinted filter material of a desired opacity characteristic, and/or polarization characteristic, may be applied to the other portion of the element that is interposed between the source and the dartboard to provide a different intensity, color, and polarization of dartboard illumination than would be provided by the transmission of illumination through the translucent element alone.

Ballast 1600 is a standard commercially available ballast designed for operation of a 60 watt fluorescent lamp. Alternatively, a neon lamp, with a tubing formed in a 20 inch diameter circle, may be employed in place of fluorescent lamp 1200, and powered by a 30 milli-watt solid state transformer. Clearly, a source of illumination may be employed that is tinted in color to illuminate the dartboard with a desired color or portion of the visible spectrum. Moreover, the intensity of the illumination may be adjusted by, for example, the use of a dimmer switch in electrical connection with the electrical power supplied to the source.

Figure 3:
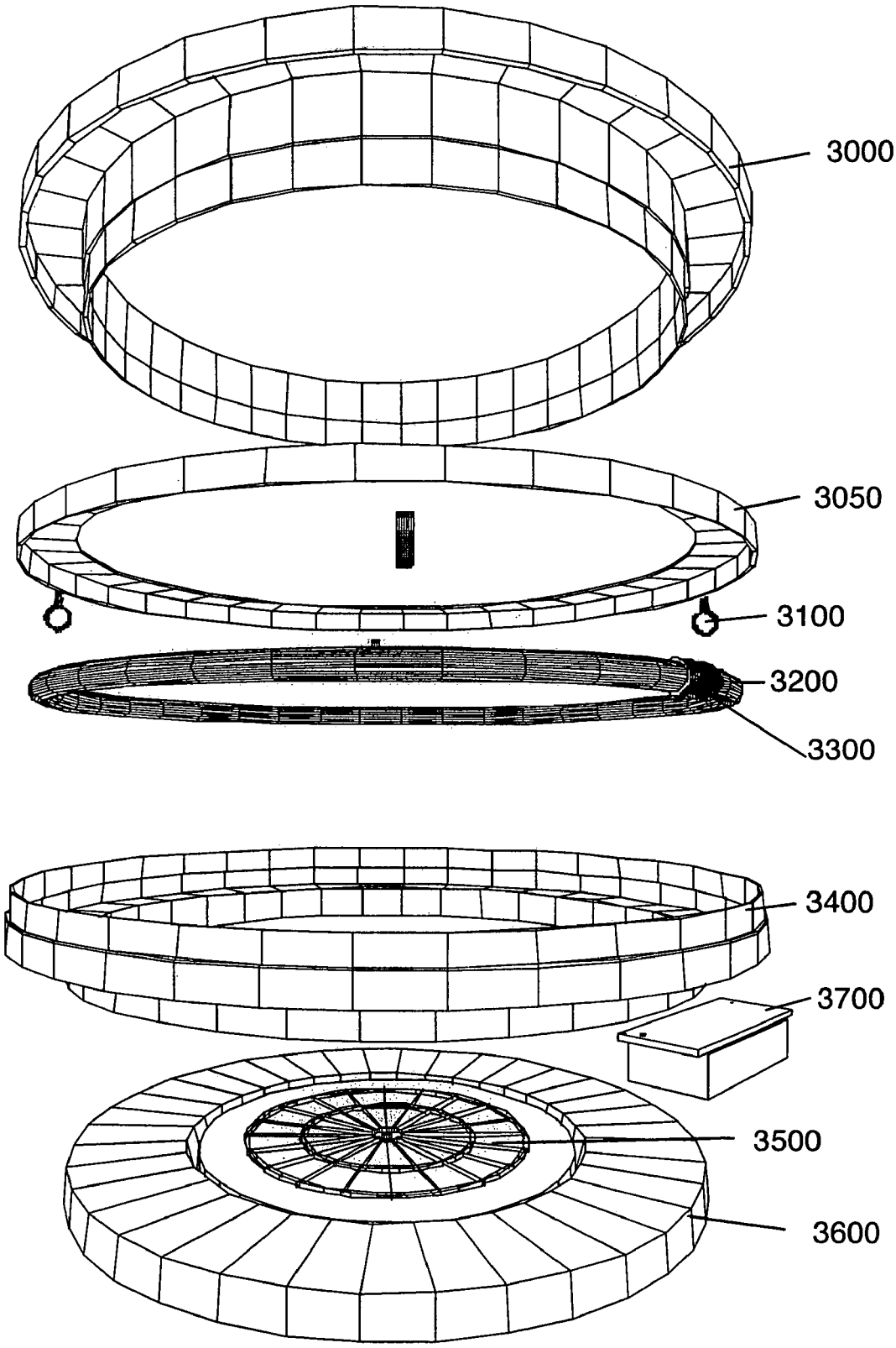
FIG. 3 shows assembly of another embodiment of the invention.

The assembly of another preferred embodiment of the present invention is illustrated in FIG. 3. A transparent or translucent flexible plastic protector 3000 is molded from vinyl that preferably is ⅛ inch to ¼ inch thick and three inches in height, and of suitable length to achieve the desired circumference. An opaque or partially opaque rigid plastic filter 3050 is provided to filter or even eliminate direct illumination from the light source to the player. Filter 3050 is removably inserted into and around protector 3000 and is held snugly by friction forces. A fluorescent light source 3200 is removably attached to filter 3050 by clips 3100. A second protector 3400, made of opaque plastic, is removably inserted into and around filter 3050 and protector 3000, and is held snugly by friction forces. A safety apparatus 3600 is removably inserted into protector 3400 and is held snugly by friction forces. The dartboard 3500 removably inserts into an interior circumference of safety apparatus 3600.

Safety apparatus 3600 serves to protect the wall behind the dartboard from miss-thrown darts, and is often a feature of prior art dartboard installations. In this embodiment the lightsource is located further away from the outer periphery of the dartboard, to accommodate the safety apparatus and further reducing the chance of miss-thrown darts hitting the fixture. For this embodiment, a fluorescent lamp of T9 size may be formed into a lamp source with a diameter of 32 inches to be used in conjunction with a Circline-type connector of the same radius or other suitable connector. Clearly, however, the embodiment of FIG. 3 can be employed without safety apparatus 3600, with correspondingly reduced radii of the elements forming the invention, and with the dartboard removably insertable into protector 3400.

Figure 4:
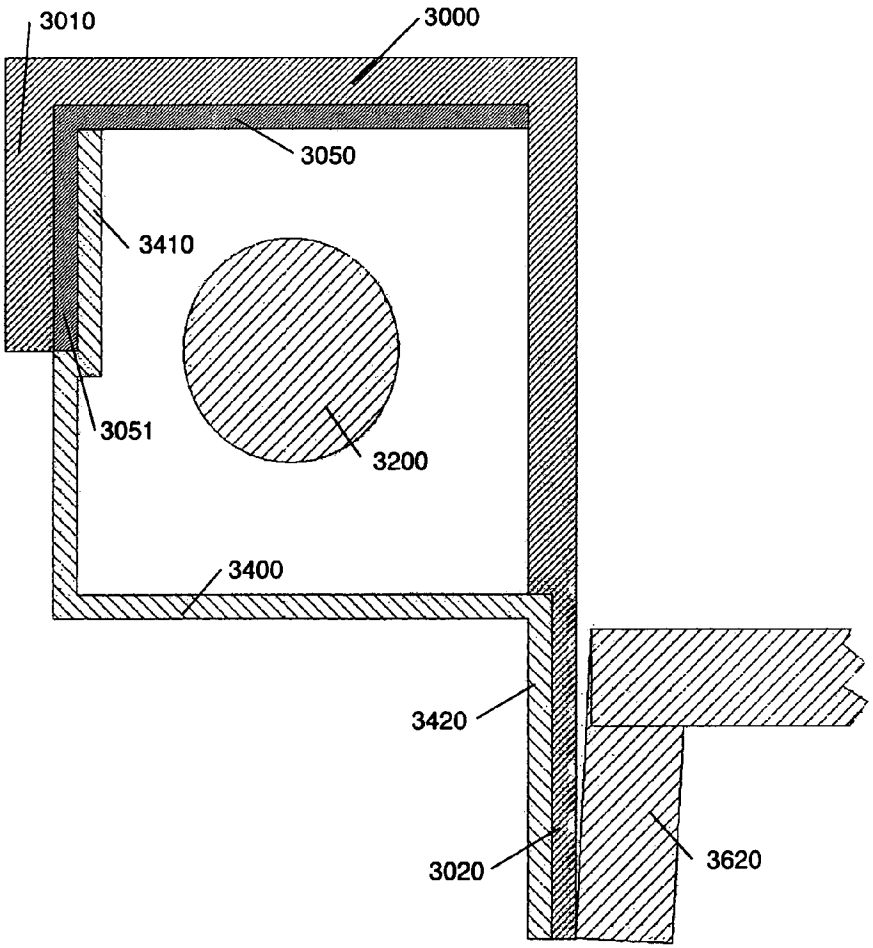
FIG. 4 shows a cross sectional view of a portion of the assembly of FIG. 3.

FIG. 4 is a cross sectional view of a portion of the assembly of FIG. 3. FIG. 4 shows that a section 3051 of filter 3050 removably fits snugly within an interior circumference of section 3010 of protector 3000. A section 3410 of protector 3400 removably fits snugly within an interior circumference of section 3051 of filter 3050. Also, a section 3020 of protector 3000 removably fits snugly within an interior circumference of section 3420 of filter 3050. Finally, a section 3620 of surrounding apparatus 3600 removably fits snugly with an interior diameter of protector 3000. The apparatus is dimensioned to enable fluorescent lamp 3200 to be held by clips 3100 (not shown in FIG. 4) so that the light source does not make contact with any interior surface of protectors 3000 and 3400 or filter 3050.

As before with tubing 1000, discussed with reference to FIGS. 1 and 2, filter 3050 may be entirely opaque to prevent direct illumination from the source to the player. Indeed, the interior surface of filter 3050 may be made reflective to reflect illumination impinging thereon back toward the dartboard. Alternatively, filter 3050 may be selected of a partially opaque or translucent material to control the intensity, color, and polarization of illumination that emits from the source directly to the player. Also, as discussed before with reference to FIGS. 1 and 2, protective structure 3000 may be made of a filtering material to control the intensity, color, and polarization of dartboard illumination.

Thus, although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for illuminating a dartboard, comprising:

providing a distributed light source that substantially encircles the entire periphery of the dartboard, so that illumination emanates toward the surface of the dartboard to be reflected from said surface, thereby enabling substantially symmetrical illumination of the dartboard without substantial glare or shadow; and providing a protective surface to provide protection from physical impact to a source of the illumination.

2. The method of claim 1, wherein at least a portion of said protective surface allows illumination to emanate through the protective surface toward the dartboard.

3. The method of claim 1, wherein at least a portion of said protective surface provides a filter of illumination.

4. The method of claim 3, wherein the filter enables control of intensity and frequency spectrum of illumination transmitting through said portion of said protective surface.

5. The method of claim 1, wherein at least a portion of said protective surface provides a filter of a polarization of illumination.

6. The method of claim 1, wherein at least a portion of said protective surface filters illumination emanating directly from a source to a player in front of the dartboard.

7. The method of claim 6, wherein the filter is opaque.

8. The method of claim 6, wherein the filter comprises a reflective material to reflect a portion of illumination emanating from a source toward the dartboard.

9. The method of claim 1, wherein said protective structure comprises a first portion providing a first filter of illumination, and a second portion providing a second filter of illumination.

10. The method of claim 9, wherein one of said filters is opaque.

11. The method of claim 1, wherein illumination is provided by a distributed light source that encompasses substantially the entire periphery of the dartboard.

12. The method of claim 1, wherein the illumination is provided by a plurality of discrete sources distributed around the periphery of the dartboard.

13. The method of claim 1, wherein said protective structure is removably attachable to a dartboard apparatus.

14. A dartboard illumination apparatus, comprising an illumination assembly to provide illumination from a distributed light source that substantially encircles the entire periphery of the dartboard to provide substantially symmetrical illumination of a surface of the dartboard; and a protective structure to provide protection from physical impact to a source of the illumination; wherein at least a portion of the protective structure is translucent.

15. The apparatus of claim 14, wherein the illumination is provided from a plurality of discrete sources distributed around the periphery of the dartboard.

16. The apparatus of claim 14, wherein said protective surface is removably attachable to a dartboard apparatus.

17. The apparatus of claim 14, wherein said protective surface comprises a first portion providing a first filter of illumination, and a second portion providing a second filter of illumination.

18. The apparatus of claim 14, wherein at least a portion of said protective surface filters illumination emanating directly from a source to a player in front of the dartboard.

19. A dartboard illumination apparatus, comprising:

a distributed light source that substantially encircles the entire periphery of the dartboard, so that illumination emanates toward the surface of the dartboard to be reflected from said surface, thereby enabling substantially symmetrical illumination of the dartboard without substantial glare or shadow; and a protective surface to provide protection from physical impact to a source of the illumination.

* * * * *